United States Patent [19]

Reeve

[11] Patent Number: 4,561,544

[45] Date of Patent: Dec. 31, 1985

[54] CHILD RESISTANT CONTAINER

[75] Inventor: Randy F. Reeve, Washington Court House, Ohio

[73] Assignee: Calmar, Inc., City of Industry, Calif.

[21] Appl. No.: 566,226

[22] Filed: Dec. 28, 1983

[51] Int. Cl.[4] ..... B65D 6/06; B65D 85/56

[52] U.S. Cl. ..... 206/540; 206/1.5; 206/807; 220/346

[58] Field of Search ..... 206/1.5, 387, 528, 534, 206/534.1, 534.2, 535, 538, 539, 540, 807; 220/8, 345, 346, 348, 351; 229/7 SC, 9–11, 19, 20; 312/348, 350

[56] References Cited

U.S. PATENT DOCUMENTS

| | | | |
|---|---|---|---|
| 1,925,316 | 9/1933 | Fullmer | 206/1.5 |
| 3,812,963 | 5/1974 | Zahuranec et al. . | |
| 3,888,350 | 6/1975 | Horvath . | |
| 3,907,103 | 9/1975 | Shaw . | |
| 4,046,255 | 9/1977 | Ackeret . | |
| 4,076,117 | 2/1978 | Wisdom et al. . | |
| 4,113,098 | 9/1978 | Howard . | |
| 4,120,400 | 10/1978 | Kotyuk . | |
| 4,126,224 | 11/1978 | Laauwe et al. . | |
| 4,192,422 | 3/1980 | Kotyuk . | |
| 4,284,204 | 8/1981 | Carey . | |
| 4,342,403 | 8/1982 | Badtke et al. . | |
| 4,364,488 | 12/1982 | Anjou . | |

FOREIGN PATENT DOCUMENTS

| | | | |
|---|---|---|---|
| 0495206 | 6/1954 | Italy | 206/534.1 |
| 0206794 | 11/1923 | United Kingdom | 206/270 |

*Primary Examiner*—William T. Dixson, Jr.
*Assistant Examiner*—Jimmy G. Foster
*Attorney, Agent, or Firm*—Watson, Cole, Grindle & Watson

[57] ABSTRACT

A child resistant container for pills and the like has a tray which slidably engages a lid and is locked in a fully closed position as a spring arm on the tray urges a locking detent on the arm into engagement with a locking aperture located in an adjacent side wall of the lid. Manual depression of the detent releases the tray for opening as an exposed front wall thereof is pulled.

4 Claims, 5 Drawing Figures

CHILD RESISTANT CONTAINER

BACKGROUND OF THE INVENTION

This invention relates generally to a child resistant container for pills and the like including a tray and a lid engageable therewith for relative sliding movement between closed and open positions of the tray. More particularly, the tray and lid are locked together in the closed position, by a locking mechanism which includes a locking detent required to be continually depressed for unlocking the tray while pulling it open.

Various types of child resistant or safety containers have been developed which include a tray and a slidably engaging lid with the tray locked in the closed position using some type of locking mechanism. However, many of such containers are relatively complex in construction and operation, and largely require manual deformation of the lid and/or tray for releasing the locking mechanism prior to pulling open the tray. However, many of these pill and capsule containers, although child resistant, have proven inconvenient and cumbersome to operate for the users.

SUMMARY OF THE INVENTION

It is therefore an object of the present invention to provide a child resistant container of the aforementioned general type which is not only durable, economical and of simple construction, but which is convenient and easy to operate as an effective child-safe container.

Another object of the present invention is to provide such a container wherein a spring arm in the form of a resilient locking tongue is mounted at one end on the front wall of the tray and engages with the lid as a locking detent button thereon extends into a locking aperture in a side wall of the lid for locking the tray in a fully closed position. The button must be manually released from the locking aperture while the operator grasps the front wall and pulls open the tray.

A further object of this invention is to provide such a container as having sub-features such as a cutout provided in the side wall of the lid adjacent the front wall of the tray to permit the same to be easily grasped, and a stop element on such wall in alignment with the locking button in its release position for limiting the open extent of the tray.

Other objects, advantages and novel features of the invention will become more apparent from the following detailed description of the invention when taken in conjunction with the accompanying drawings.

DETAILED DESCRIPTION OF THE INVENTION

Figure 1:
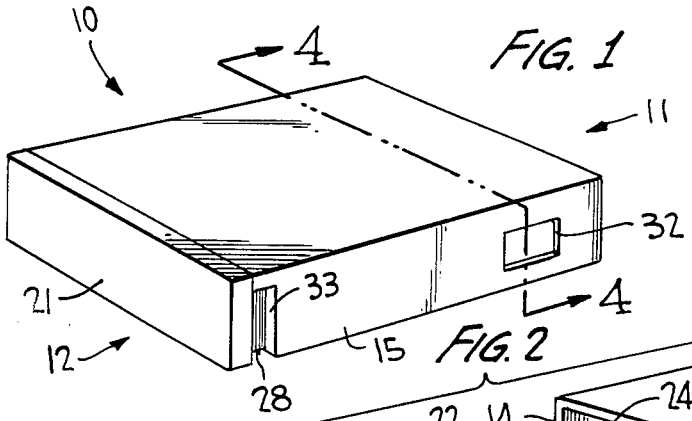
FIG. 1 is a perspective view of the child resistant container according to the invention, shown with the tray locked in its fully closed position.
Figure 2:
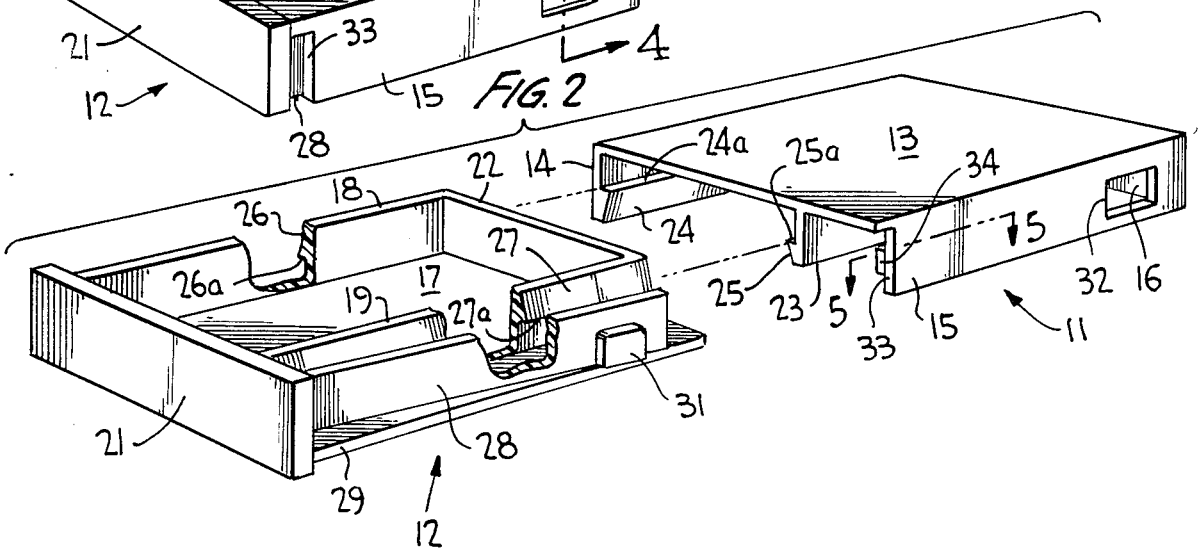
FIG. 2 is a perspective view of the present container showing the tray and lid completely separated for clearly illustrating details thereof.

Turning now to the drawings wherein like reference characters refer to like and corresponding parts throughout the several views, the child-safe container according to the invention is generally designated 10 and includes a lid 11 in sliding engagement with a tray or drawer 12 shown locked in its fully closed position in FIG. 1. The lid comprises a generally rectangular top wall 13 and connecting side walls 14, 15 joined thereto. A connecting rear wall 16, joined to the top and side walls, may likewise be provided but could be eliminated without departing from the invention.

The tray or drawer is engageable with the lid for relative sliding movement between closed and open positions of the tray, and comprises a generally rectangular bottom wall 17, opposed side walls 18, 19, a front wall 21 and a rear wall 22, the side, front and rear walls being joined to the bottom wall to form a receptacle therewith.

Figure 4:
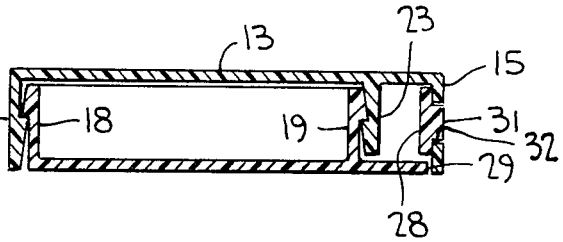
FIG. 4 is a cross-sectional view of the container taken substantially along the line 4—4 of FIG. 1.

A wall 23 depends from top wall 13 of the lid, lies inwardly of side wall 15 and parallel thereto, and lies outwardly and adjacent side wall 19 of the tray (FIG. 4). Inwardly directed flanges 24 and 25 are provided on walls 14 and 23 of the lid and respectively present undercut surfaces 24*a*, 25*a*. Corresponding, but outwardly directed, flanges 26 and 27 are provided on side walls 18 and 19 of the tray and define undercut surfaces 26*a* and 27*a* which respectively engage undercut surfaces 24*a* and 25*a* for sliding movement between open and closed positions of the tray. The undercut surfaces on the lid and the tray are suitably spaced from their respective top and bottom walls so that, when engaged, the tray will be snugly received within the lid, and front wall 21 of the tray will completely close the open front end of the lid in the locked position of FIG. 1.

Figure 3:
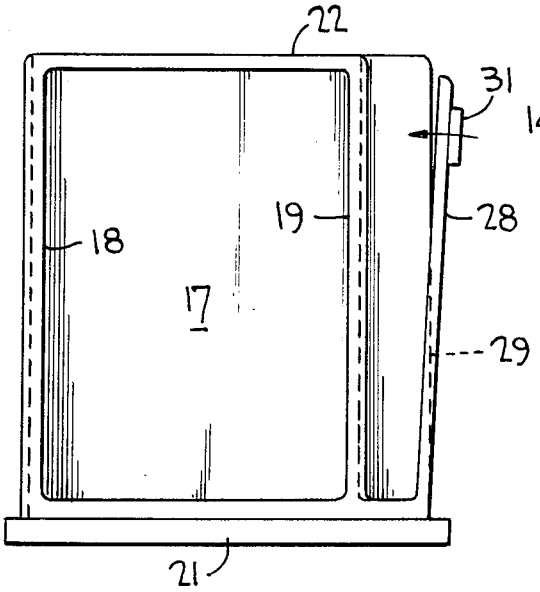
FIG. 3 is a top plan view of the tray with its spring arm shown in a relaxed condition.

Container 10 is rendered child resistant according to the invention by the provision of a spring arm or resilient tongue 28 mounted at one end to the inner surface of front wall 21 and extending toward rear wall 22. The spring arm, at its root end, lies slightly inwardly of an adjacent end of front wall 21 a distance substantially equal to the thickness of side wall 15 of the lid so that, when the lid and tray are interengaged, the outer surface of wall 15 will be substantially flush with this edge of front wall 21, as shown in FIG. 1. And, arm 28 diverges slightly outwardly of side wall 19 of the tray such that its outer surface likewise diverges outwardly of end edge 29 of bottom wall 17. And, an outwardly extending locking button or detent 31 is provided adjacent the free end of spring arm 28, and is spring biassed toward side wall 15, when moved inwardly in the direction of the arrow of FIG. 3, as the outer surface of the detent bears against the inner surface of wall 15 when the lid and tray are interengaged.

Figure 5:
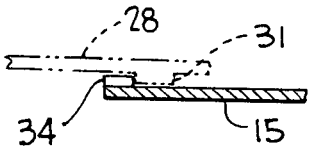
FIG. 5 is a detail view, in section, taken substantially along the line 5—5 of FIG. 2.

A locking aperture 32, corresponding in shape to that of detent 31, is provided in wall 15 of the lid and is located a distance from the inner surface of wall 21 of the tray equal to the spacing between detent 31 and such surface so that, in a fully closed position of the tray shown in FIG. 1, detent 31 fully extends into locking aperture 32 as it snaps into place. For opening the tray, the operator depresses detent 31 with a finger of one hand into a release position inwardly away from its locking aperture and, while maintaining the button depressed, grasps front wall 21 with the other hand for sliding the tray outwardly of the lid. To ensure a positive grasp of an end of front wall 21, side wall 15 may be provided with a cutout section 33 at the forward open end of the lid. And, a limit stop 34 (FIG. 5) may be provided on the inner surface of wall 15 adjacent this cutout section and in alignment with locking detent 31 so as to avoid separation of the tray from the lid when fully opened as the locking detent bears against this limit stop.

From the foregoing, it can be seen that a safety closure has been developed which is completely child resistant in that it requires both hands of the operator to depress the locking detent and maintain it slightly inwardly of side wall 15 while at the same time grasping front wall 21 of the tray and pulling it open. The spring arm is completely hidden from view, does not interfere with the opening and closing movements of the tray, and does not detract from the overall neat and streamlined appearance of the container. And, the tray is self-locking in its fully closed position as the locking detent simply snaps into place within its locking aperture.

Obviously, many modifications and variations of the present invention are made possible in the light of the above teachings. It is therefore to be understood that within the scope of the appended claims the invention may be practiced otherwise than as specifically described.

What is claimed is:

1. A child resistant container for pills and the like, comprising a lid of one-piece construction having an open front, a top wall and connecting side walls integrally joined thereto, a wall integrally joined to and depending from said top wall lying parallel to and spaced inwardly of one of said side walls, a tray of one-piece construction having a bottom wall and connecting side walls and end walls integrally joined thereto forming a receptacle, said side walls of said tray being in sliding engagement with said depending wall and the other of said side walls of said lid, means on said depending wall and said other wall in engagement with said tray for slideably supporting and guiding said tray within said lid between closed and open positions of said tray, one of said end walls defining a closure for said open front of said lid, a spring arm integrally connected only at one end to said closure and extending toward the other of said end walls, said arm being spaced inwardly of an adjacent end edge of said closure, lying between said one side wall and said depending wall of said lid and being spring biased for movement toward and away from said one side wall, an outwardly extending lock button on said arm adjacent the free end thereof and spaced a predetermined distance from said closure, and said one side wall of said lid having an aperture therein spaced from said closure equal to said predetermined distance in said closed position for the reception of said button under the spring bias of said arm for locking said lid and said tray together in the closed position, said button being manually depressible for movement out of said aperture against the spring bias of said arm into a release position to facilitate the opening of said tray while continuing to manually depress said button.

2. The container according to claim 1, wherein said engagement means comprise confronting surfaces on said lid and said tray.

3. The container according to claim 1, wherein said engagement means comprise inwardly directed flanges on said other side wall of said lid and on said depending wall, and outwardly directed flanges on said side walls of said tray in engagement with said inwardly directed flanges.

4. The container according to claim 1, wherein said one wall of said lid has a cutout therein at said open front of said lid to ensure a positive manual grasp of said one end wall for pulling open said tray.

* * * * *